US010720291B2

(12) United States Patent
Peters et al.

(10) Patent No.: US 10,720,291 B2
(45) Date of Patent: Jul. 21, 2020

(54) SWITCH AND METHOD FOR DISCONNECTING A SWITCH

(71) Applicant: ABB Power Grids Switzerland AG, Baden (CH)

(72) Inventors: Hauke Peters, Hanau (DE); Horst Schalber, Schöneck (DE); Michael Mann, Alzenau (DE); Ralph Uhl, Frankfurt am Main (DE)

(73) Assignee: ABB Power Grids Switzerland AG, Baden (CH)

( * ) Notice: Subject to any disclaimer, the term of this patent is extended or adjusted under 35 U.S.C. 154(b) by 0 days.

(21) Appl. No.: 16/285,882

(22) Filed: Feb. 26, 2019

(65) Prior Publication Data

US 2019/0198272 A1 Jun. 27, 2019

Related U.S. Application Data

(63) Continuation of application No. PCT/EP2017/070855, filed on Aug. 17, 2017.

(30) Foreign Application Priority Data

Aug. 26, 2016 (DE) ..... 10 2016 115 912

(51) Int. Cl.
*H01H 1/38* (2006.01)
*H01H 3/30* (2006.01)
(Continued)

(52) U.S. Cl.
CPC ..... *H01H 33/40* (2013.01); *H01H 33/12* (2013.01); *H01H 1/385* (2013.01); *H01H 3/3052* (2013.01); *H01H 5/06* (2013.01); *H01H 31/003* (2013.01)

(58) Field of Classification Search
CPC ..... H01H 33/40; H01H 33/42; H01H 33/12; H01H 33/122; H01H 33/14; H01H 33/56;
(Continued)

(56) References Cited

U.S. PATENT DOCUMENTS 2,811,612 A 10/1957 Atkinson
4,149,054 A * 4/1979 Kopplin ..... H01H 33/045 200/318
(Continued)

FOREIGN PATENT DOCUMENTS

CH 653474 A5 12/1985
DE 3114837 A1 2/1982
(Continued)

OTHER PUBLICATIONS

German Patent Office, Search Report issued in corresponding DE application No. 10 2016 115 912.3, dated Jun. 23, 2017, 7 pp.

*Primary Examiner* — William A Bolton
(74) *Attorney, Agent, or Firm* — Sage Patent Group

(57) ABSTRACT

A switch including a housing, a first contact arrangement having a first commutation contact element and a first contact, a second contact arrangement having a second commutation contact element and a second contact, and also a nominal contact arrangement. The first commutation contact element and the second commutation contact element form a snap-action connection with one another in the closed position of the commutation contact element. When the switch is closed, a distance between the first contact and the second contact is smaller than a distance between the first commutation contact element and the second commutation contact element in the direction of the axis.

20 Claims, 3 Drawing Sheets

(51) Int. Cl.
*H01H 5/06* (2006.01)
*H01H 31/00* (2006.01)
*H01H 33/12* (2006.01)
*H01H 33/40* (2006.01)

(58) Field of Classification Search
CPC .. H01H 33/64; H01H 33/7053; H01H 33/901; H01H 31/02; H01H 3/3052; H01H 5/06
USPC ..... 218/14, 12, 16, 20, 43, 45, 48, 18; 200/146 R, 435, 252
See application file for complete search history.

(56) References Cited

U.S. PATENT DOCUMENTS 4,395,607 A * 7/1983 Roth ..... H01H 33/98 218/43
4,427,859 A * 1/1984 Cancio ..... H01H 33/982 218/68
4,445,014 A * 4/1984 Gruner ..... H01H 33/12 218/12
4,463,230 A * 7/1984 Perrenoud ..... H01H 33/982 218/27
4,539,448 A * 9/1985 Schulz ..... H01H 33/16 218/12
5,237,137 A * 8/1993 Lorenz ..... H01H 33/122 218/14
5,898,150 A * 4/1999 Gallix ..... H01H 33/905 218/60
6,236,010 B1 5/2001 Rostron
2013/0248492 A1 * 9/2013 Froebel ..... H01H 1/385 218/18

FOREIGN PATENT DOCUMENTS

EP 2728602 A1 5/2014
FR 3016470 A1 7/2015

* cited by examiner

SWITCH AND METHOD FOR DISCONNECTING A SWITCH

TECHNICAL FIELD

The invention relates to the field of switches, specifically isolating switches, combined isolating and grounding switches, power switches and/or grounding switches, and further specifically isolating switches, combined isolating and grounding switches, power switches and/or grounding switches for high voltages. The invention specifically relates to a switch and a method for disconnecting a switch. Specifically, the invention relates to a switch having a snap-action connection, and to a method for disconnecting a switch which comprises a release of a snap-action connection.

PRIOR ART

Electric switches, for example isolating switches, are employed for the opening (or closing) of circuits by the opening (or closing) of electrical components. An isolating switch can thus be employed for the interruption of a circuit. In general, an isolating switch is employed for the opening and/or closing of a connection if no current, or only a very small current is flowing, for example after the switch-off of the current flow or before the switch-on of the current flow. This distinguishes an isolating switch from a power switch, which is employed for the switch-on and/or switch-off of the current flow, even at higher currents.

During the opening and closing of an electric switch, an arc can be generated, i.e. a self-sustained gas discharge which has a sufficiently high electrical potential difference for the maintenance, by impulse ionization, of the requisite high current density, between commutation contact elements or between commutation contact elements and a housing of the switch. The arc can damage, or even destroy the commutation contact elements or the housing.

A representative of the prior art is known from CH653474A5.

BRIEF PRESENTATION OF THE INVENTION

A switch and a method for disconnecting a switch are thus provided, which resolve at least some of the problems of the prior art.

In consideration of the above, a switch as claimed in claim 1 and a method as claimed in claim 11 are provided. Further exemplary embodiments, configurations and aspects of the present invention proceed from the dependent patent claims, the description and the attached drawings.

According to one aspect of the invention, a switch is provided. The switch comprises a housing, a first contact arrangement having a first contact element or commutation contact element and a first contact, and a second contact arrangement having a second contact element or commutation contact element and a second contact. The switch further comprises a nominal contact arrangement for the transmission of electric power during the operation of the switch, in the closed state thereof. The first contact is moveable along an axis between a closed contact position, in which the first contact engages with the second contact, and an open contact position, in which the first contact is separated from the second contact. The first commutation contact element is moveable along an axis between a closed commutation contact element position, in which the first commutation contact element engages with the second commutation contact element, and an open commutation contact position, in which the first commutation contact element is separated from the second commutation contact element. The first commutation contact element and the second commutation contact element are designed, in the closed commutation contact element position, to mutually constitute a snap-action connection. The first commutation contact element is coupled to the first contact via a first limit stop, a second limit stop and an elastic element such that a) when the first contact is moved to the closed contact position, the first limit stop entrains the first commutation contact element to the closed commutation contact position, b) when the first contact, with the snap-action connection in place, is moved from the closed contact position in the direction of the open contact position, the elastic element applies tension to the first commutation contact element in the direction of the open commutation contact element position, c) when the first contact, during the movement thereof in the direction of the open contact position, overshoots a defined limit stop position, the second limit stop entrains the first commutation contact element in the direction of the open commutation contact element position, in order to release the snap-action connection.

The switch according to the invention permits the achievement of a number of advantages, in relation to known switches. For example, the speed of opening of the commutation contact elements can be increased. The risk of the occurrence of arcing can be reduced accordingly. Moreover, the risk of the occurrence of arcing during the closing of the switch can also be reduced.

According to a further aspect of the invention, a method is provided for disconnecting a switch. The switch comprises a housing, a first contact arrangement having a first commutation contact element and a first contact, and a second contact arrangement having a second commutation contact element and a second contact, wherein the first contact projects beyond the first commutation contact element in the direction of the second contact arrangement, and the second contact projects beyond the second commutation contact element in the direction of the first contact arrangement. The switch further comprises a nominal contact arrangement for the transmission of electric power during the operation of the switch, in the closed state thereof. Disconnection proceeds from a closed commutation contact element position, in which the first commutation contact element engages with the second commutation contact element, to an open commutation contact element position, in which the first commutation contact element is separated from the second commutation contact element. The method comprises a movement, at a first speed, of the first contact, in the presence of a snap-action connection between the first commutation contact element and the second commutation contact element, along an axis from a closed contact position, in which the first contact engages with the second contact, to an open contact position, in which the first contact is separated from the second contact. When the first contact, in the presence of a snap-action connection, is moved from the closed contact position in the direction of open contact position, the elastic element applies tension to the first commutation contact element in the direction of the open commutation contact element position. When the first contact, during the movement in the direction of the open contact position, overshoots a defined limit stop position, the snap-action connection is released, and the first commutation contact element moves in the direction of the open commutation contact element position at a second speed, wherein the second speed is greater than the first speed.

When the switch is closed, a distance between the first contact and the second contact, in relation to a distance between the first commutation contact element and the second commutation contact element in the direction of the axis, is dimensionally smaller.

In a further form of embodiment of the method, upon the closing of the switch, the first contact and the second contact engage (establish contact) temporally in advance of the first commutation contact element and the second commutation contact element. Accordingly, an arc is deliberately constituted between the first contact and the second contact, as a result of which the first commutation contact element and the second commutation contact element, during the operation of the switch, are protected against damage by arc erosion or similar. Upon the opening of the switch, the electrical connection between the first contact and the second contact is interrupted temporally in advance of the electrical connection between the first commutation contact element and the second commutation contact element. This configuration is advantageous, in order to ensure that an arc is constituted between the first commutation contact element and the second commutation contact element, such that the first contact and the second contact, during the operation of the switch, is/are protected against damage.

BRIEF DESCRIPTION OF THE DRAWINGS

Hereinafter, exemplary embodiments of the switch according to the invention are schematically represented and described in greater detail, with reference to the figures. In the figures, identical or identically-functioning elements are identified by the same reference numbers. In the figures.

DETAILED DESCRIPTION

Figure 1:
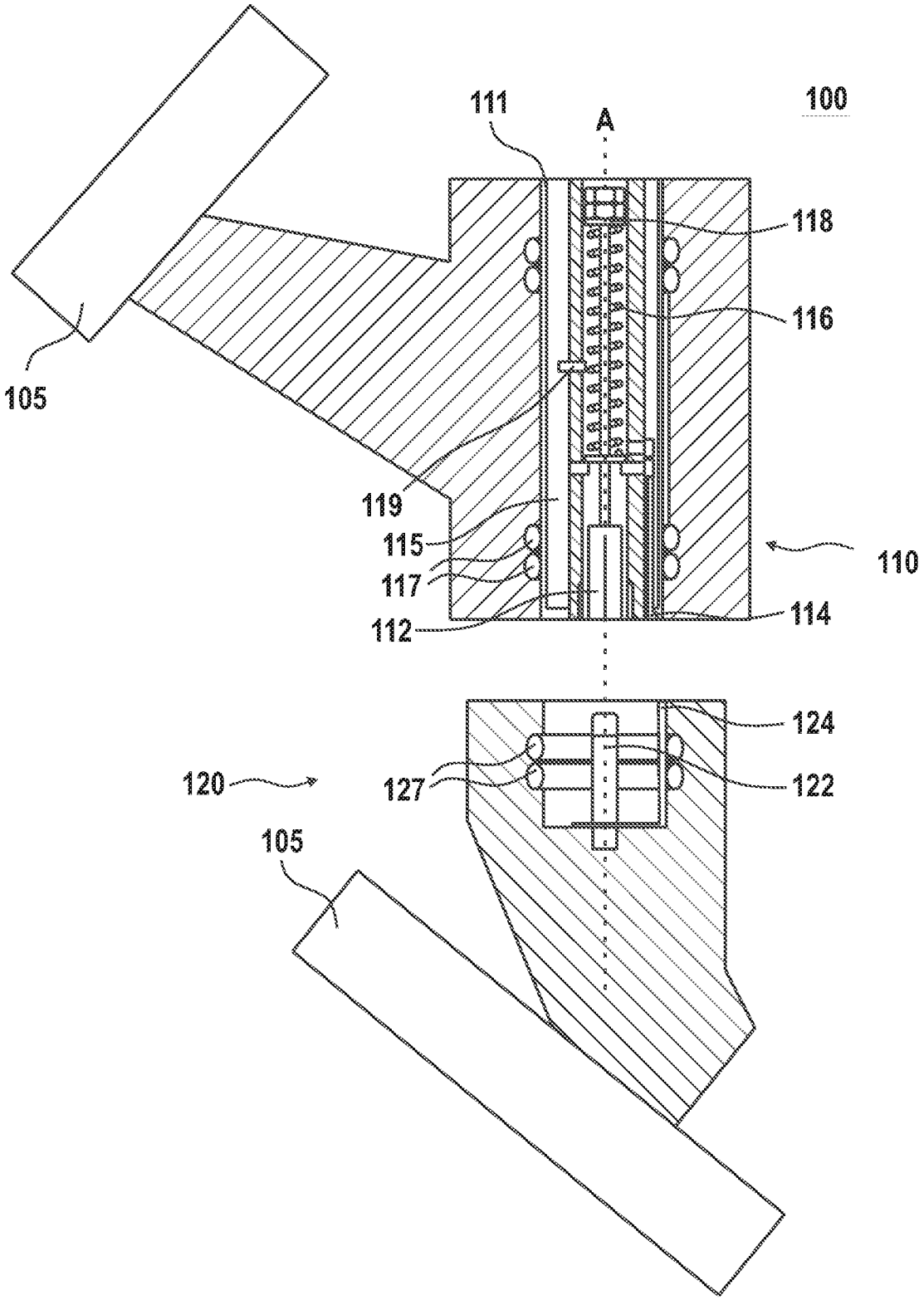
FIG. 1 shows a schematic partial view of a switch in an open state, according to exemplary embodiments of the invention.

FIG. 1 shows a schematic partial view of a switch 100. The switch 100 comprises a housing 105, a first contact arrangement 110 and a second contact arrangement 120, together with a nominal contact arrangement 117, 115, 124, which will be described in greater detail hereinafter. The switch 100 is represented in an open switch position, in which the first contact arrangement 110 and the second contact arrangement 120 are separated from one another. Specifically, the first contact arrangement 110 comprises a first contact element 112 or commutation contact element 112, and the second contact arrangement 120 comprises a second contact element 122 or commutation contact element 122 auf. In the open switch position, the first commutation contact element 112 and the second commutation contact element 122 are also arranged in an open commutation contact element position, in which the first commutation contact element 112 is separated from the second commutation contact element 122. Additionally, the first contact arrangement 110 comprises a first contact 114, and the second contact arrangement 120 comprises a second contact 124. In the open switch position, the first contact 114 and the second contact 124 are also arranged in an open contact position, in which the first contact 114 is separated from the second contact 124. Moreover, in the interests of greater legibility and clearer understanding, not all the elements of the switch 100 are marked in the figures with hatching, even though they are represented in section.

The first commutation contact element 112 is moveable along an axis A. The axis A can extend from the first contact arrangement 110 to the second contact arrangement 120. Specifically, the first commutation contact element 112 is moveable along the axis A between the open commutation contact element position and the closed commutation contact element position, in which the first commutation contact element 112 engages with the second commutation contact element 122 (see FIG. 2). If the first commutation contact element 112 and the second commutation contact element 114 are in the closed commutation contact element position, a current, specifically a commutation current, can flow via the first commutation contact element 112 and the second commutation contact element 114 upon the opening of the switch 100. In the closed switch position, however, preferably no current, or only a very small current flows via the first commutation contact element 112 and the second commutation contact element 114. The first commutation contact element 112 and the second commutation contact element 114 can be arcing contacts or commutation contacts, specifically for the opening of the switch 100.

The first contact 114 is moreover moveable along the axis A. Specifically, the first contact 114 is moveable between the open contact position and a closed contact position, in which the first contact 114 engages with the second contact 124. Specifically, the first contact 114 is moveable along the axis A between the open contact position and a closed contact position, in which the first contact 114 engages with the second contact 124. If the first contact 114 and the second contact 124 are in the closed contact position, a current, specifically a commutation current, can flow via the first contact 114 and the second contact 124 upon the closing of the switch 100. In the closed switch position, however, preferably no current, or only a very small current flows via the first contact 114 and the second contact 124. Thus, in normal duty, preferably no nominal current flows via the first contact 114 and the second contact 124. The first contact 114 and the second contact 124 can be arcing contacts or commutation contacts, specifically for the closing of the switch 100.

The first commutation contact element 112 and the second commutation contact element 122 are designed, in the closed commutation contact element position, to mutually constitute a snap-action connection. In the context of the present disclosure, a "snap-action connection" can be understood as a functional element for the simple and detachable form-fitted connection of components, such as the first commutation contact element 112 and the second commutation contact element 122. By this arrangement, at least one connecting part, such as the first commutation contact element 112 and/or the second commutation contact element 122, can undergo elastic strain and interlock thereafter in a detachable manner. A positive connection can thus be formed, specifically between the first commutation contact element 112 and the second commutation contact element 122. Specifically, in the presence of a snap-action connection, a current can flow via the first commutation contact element 112 and the second commutation contact element 122.

Upon the closing of the switch 100, a distance between the first contact 114 and the second contact 124, arranged in opposition thereto in the direction of the axis A, in comparison with a distance between the first commutation contact element (112) and the second commutation contact element (122), in the direction of the axis (A), is dimensionally smaller. As a result, upon the closing of the switch 100, wear occurs on this contact pair 114, 124, and not on the other contact pair comprised of the first commutation contact element 112 and the second commutation contact element 122.

In exemplary embodiments (which can generally be executed in all the variants of the invention disclosed), the first contact arrangement 110 can comprise a contact part 115 and/or a first discharge contact 117. The contact part 115 can engage with the first discharge contact 117. The second contact arrangement 120 can comprise a second discharge contact 127. Specifically, the contact part 115 can be moveable along the axis A between a closed contact part position, in which the contact part 115 engages with the second discharge contact 127, and an open contact part position, in which the contact part 115 is separated from the second discharge contact 127. The contact part 115 can thus constitute a stable electrical connection between the first discharge contact 117 and the second discharge contact 127. Specifically, the switch, in the closed switch position, can assume the closed contact part position and/or, in the open switch position, can assume the open contact part position. The contact part 115 can be moved in combination with the first contact 114.

The switch 100 can thus be designed such that the nominal current flow proceeds via the contact part 115. The contact part 115 can thus be a nominal contact. For example, the switch 100 can be rated for a nominal current flow equal to or greater than 100 A, specifically equal to or greater than 1,000 A, typically equal to or greater than 1,600 A and/or for a nominal current flow equal to or lower than 4,000 A and/or for a voltage equal to or greater than 52 kV, typically equal to or greater than 100 kV. By a configuration of a switch according to the present disclosure, exceptionally dimensionally compact switchgear can be produced. As the demand for exceptionally compact switchgear, in comparison with high-voltage switchgear for nominal voltages of the order of 170 kV or higher, is particularly high, the present invention permits the satisfaction of this sustained requirement.

The first discharge contact 117 and/or the second discharge contact 127 can be configured as one or more spiral contacts 117, 127. The discharge contacts 117, 127 can be designed to conduct the nominal current to the contact part 115 and/or to divert the nominal current therefrom.

The first contact arrangement 110 further comprises an elastic element 116. The elastic element 116 can be, for example, a compression spring 116. The elastic element 116 can be connected to the first commutation contact element 112. For example, the first contact arrangement 110 can incorporate a first limit stop 118 and a second limit stop 119. The elastic element 116 can be mounted or tensioned between the first limit stop 118 and the second limit stop 119. Thus, upon a relative movement of the first limit stop 118 and the second limit stop 119 towards one another, the elastic element 116 can be tensioned and/or, upon a relative movement of the first limit stop 118 and the second limit stop 119 away from one another, the elastic element 116 can be detensioned. The elastic element 116 can thus develop a force which moves the first limit stop 118 and the second limit stop 119 away from one another.

The first limit stop 118 can be connected to the first commutation contact element 112, such that the two can be moved in combination. The second limit stop 119 can, for example, be connected to a housing 111 of the first contact arrangement 110. Specifically, the second limit stop 119 can be moved in combination with the first contact 114. The first commutation contact element 112 and/or the first limit stop 118 can also be moved against the housing 111 of the first contact arrangement 110. For example, in a design of this type, the first commutation contact element 112, by means of the first limit stop 118, the second limit stop 119 and the elastic element 116, can be coupled to the first contact 114 such that a) when the first contact 114 is moved to the closed contact position, the first limit stop 118 entrains the first commutation contact element 112 to the closed commutation contact position, b) when the first contact 114, with the snap-action connection in place, is moved from the closed contact position in the direction of the open contact position, the elastic element 116 applies tension to the first commutation contact element 112 in the direction of the open commutation contact element position, and c) when the first contact 114, during the movement thereof in the direction of the open contact position, overshoots a defined limit stop position, the second limit stop 119 entrains the first commutation contact element 112 in the direction of the open commutation contact element position, in order to release the snap-action connection.

The switch 100 can be an isolating switch, a combined isolating and grounding switch (also described as a combined disconnector), a power switch or a grounding switch. Specifically, the switch 100 can be an isolating switch, a power switch or a grounding switch for a high voltage. A high voltage can be a voltage equal to or greater than 1 kV, specifically equal to or greater than 52 kV. Moreover, the switch 100 can be a gas-insulated switch 100, which is filled with a dielectric insulating medium or gas.

In the context of the present disclosure, the dielectric insulating medium or gas in the switch 100 can be $SF_6$ gas, or any other dielectric insulating medium or arc-quenching medium, whether gaseous and/or liquid. A dielectric insulating medium or insulating gas of this type can comprise, for example, an organic fluorine compound, which is selected from the group comprised of the following: a fluoroether, an oxirane, a fluoroamine, a fluoroketone, a fluoro-olefin, a fluoronitrile, and mixtures and/or breakdown products of these substances. The terms "fluoroether", "oxirane", "fluoroamine", "fluoroketone", "fluoro-olefin" and "fluoronitrile" refer here to at least partially fluorinated substances. Specifically, the term "fluoroether" includes fluoropolyethers (e.g. Galden) and fluoromonoethers, together with hydrofluoroethers and perfluoroethers, the term "oxirane" includes hydrofluoro-oxiranes and perfluoro-oxiranes, the term "fluoroamine" includes hydrofluoroamines and perfluoroamines, the term "fluoroketone" includes hydrofluoroketones and perfluoroketones, the term "fluoro-olefin" includes hydrofluoro-olefins and perfluoro-olefins, and the term "fluoronitrile" includes hydrofluoronitriles and perfluoronitriles. Advantageously, the fluoroether, the oxirane, the fluoroamine, the fluoroketone and the fluoronitrile is or are completely fluorinated, i.e. perfluorinated.

In the exemplary embodiments, the dielectric insulating medium is selected from the group comprised of the following: one (or more) hydrofluoroether(s), one (or more) perfluoroketone(s), one (or more) hydrofluoro-olefin(s), one (or more) perfluoronitrile(s), and mixtures of these substances.

Specifically, in the context of the present invention, the term "fluoroketone" is to be understood broadly, and encompasses both fluoromonoketones and fluorodiketones, or fluoropolyketones in general. Explicitly, more than a single carbonyl group, laterally delimited by carbon atoms, can be present in the molecule. This term also includes saturated and unsaturated compounds, having bivalent and trivalent bonds between carbon atoms. The at least partially fluorinated alkyl chain in fluoroketones can be linear or branched, and optionally can also be constituted as a ring.

In the exemplary embodiments, the dielectric insulating medium and arc-quenching medium incorporate, as at least one component, a fluoromonoketone which, optionally, can also incorporate foreign atoms in the main carbon chain of the molecule, namely e.g. at least one foreign atom from the group comprised of the following: nitrogen atoms, oxygen atoms, sulfur atoms, which replace carbon atom(s) in a corresponding number. Advantageously, the fluoromonoketone, specifically perfluoroketone, has between 3 and 15 or between 4 and 12, specifically between 5 and 9 carbon atoms. Preferably, the fluoromonoketone has exactly 5 and/or exactly 6 and/or exactly 7 and/or exactly 8 carbon atoms.

In the exemplary embodiments, the dielectric insulating medium and arc-quenching medium incorporate, as at least one component, a hydrofluoroether selected from the group comprised of the following: a hydrofluoromonoether having at least 3 carbon atoms; a hydrofluoromonoether having exactly 3 or exactly 4 carbon atoms, a hydrofluoromonoether having a ratio of the number of fluorine atoms to the total number of fluorine and hydrogen atoms of at least 5:8, a hydrofluoromonoether having a ratio of the number of fluorine atoms to the number of carbon atoms in the range of 1.5:1 to 2:1; a pentafluoroethylmethylether; 2,2,2-trifluoroethyltrifluoromethylether; and mixtures of these substances.

In the exemplary embodiments, the dielectric insulating medium incorporates, as at least one component, a fluoroolefin selected from the group comprised of the following: hydrofluoro-olefins (HFOs) having at least 3 carbon atoms, hydrofluoro-olefins (HFOs) having exactly 3 carbon atoms, 1,1,1,2-tetrafluoropropene (HFO-1234yf), 1,2,3,3-tetrafluoro-2-propene (HFO-1234yc), 1,1,3,3-tetrafluoro-2-propene (HFO-1234zc), 1,1,1,3-tetrafluoro-2-propene (HFO-1234ze), 1,1,2,3-tetrafluoro-2-propene (HFO-1234ye), 1,1,1,2,3-pentafluoropropene (HFO-1225ye), 1,1,2,3,3-pentafluoropropene (HFO-1225yc), 1,1,1,3,3-pentafluoropropene (HFO-1225zc), (Z)1,1,1,3-tetrafluoropropene (HFO-1234zeZ), (Z)1,1,2,3-tetrafluoro-2-propene (HFO-1234yeZ), (E)1,1,1,3-tetrafluoropropene (HFO-1234zeE), (E)1,1,2,3-tetrafluoro-2-propene (HFO-1234yeE), (Z)1,1,1,2,3-pentafluoropropene (HFO-1225yeZ), (E)1,1,1,2,3-pentafluoropropene (HFO-1225yeE), and mixtures of these substances.

In the exemplary embodiments, the dielectric insulating medium incorporates, as at least one component or organic fluorine compound, a fluoronitrile, specifically a perfluoronitrile. Specifically, the fluoronitrile or perfluoronitrile has—at least or exactly—2 or 3 or 4 carbon atoms. Preferably, the fluoronitrile is a perfluoroalkylnitrile, specifically a perfluoro-acetonitrile, perfluoropropionitrile (C2F5CN) and/or a perfluorobutyronitrile (C3F7CN). It is particularly preferred that the fluoronitrile is a perfluoroisobutyronitrile (having the formula (CF3)2CFCN) and/or a perfluoro-2-methoxypropane-nitrile (having the formula CF3CF(OCF3)CN); of these, perfluoroisobutyronitrile is specifically advantageous, on the grounds of its low toxicity.

The dielectric insulating medium can additionally comprise a background gas or carrier gas, which is different from the organic fluorine compound, and is specifically not a fluoroether, not an oxirane, not a fluoroamine, not a fluoroketone, not a fluoro-olefin and not a fluoronitrile. In the exemplary embodiments, the carrier gas can be selected from the group comprised of the following: air, air constituents, $N_2$, $O_2$, $CO_2$, a noble gas, $H_2$; nitrogen oxides, specifically $NO_2$, NO, $N_2O$; fluorinated carbon compounds, specifically perfluorinated carbon compounds including e.g. $CF_4$; $CF_3I$, $SF_6$; and mixtures of these substances.

The first commutation contact element 112 and/or the second commutation contact element 122 can be essentially symmetrical, specifically cylindrically symmetrical, to the axis A. Specifically, the first commutation contact element 112 and the second commutation contact element 122 can be configured such that they mutually constitute a form-fitted connection. For example, the first commutation contact element 112 can be configured as a tulip contact and the second commutation contact element 122 can be configured as a contact pin, such that the first commutation contact element 112 partially encloses the second commutation contact element 122 in the closed switch state. Alternatively, the second commutation contact element 122 can be configured as a tulip contact and the first commutation contact element 112 can be configured as a contact pin such that, in the closed switch state, the second commutation contact element 122 partially encloses the first commutation contact element 112. A stable electrical connection can thus be constituted between the first commutation contact element 112 and the second commutation contact element 122.

Moreover, the second commutation contact element 122 can incorporate a taper in which, in the closed switch state, a widened section of the first commutation contact element 112 can engage, in order to constitute the snap-action connection. Alternatively, the first commutation contact element 112 can incorporate a taper in which, in the closed switch state, a widened section of the second commutation contact element 122 can engage, in order to constitute the snap-action connection. Thus, depending upon which commutation contact element 112, 122 is constituted as a contact tulip, said commutation contact element 112, 122 can incorporate the widened section whereas, conversely, the commutation contact element 112, 122 which is configured as a contact pin can incorporate the taper. In the closed commutation contact element position, the taper and the widened section can mutually engage whereas, conversely, in the open commutation contact element position, the engagement of the widened section in the taper can be released.

The first contact 114 and/or the second contact 124, considered from the axis A, can be arranged on one side of the first contact arrangement 110 or of the second contact arrangement 120 only. Alternatively, the first contact 114 and/or the second contact 124 can be configured in the circumferential direction about the axis A. For example, the first contact 114 and/or the second contact 124 can incorporate a recess for a linear drive mechanism (see below). The first contact 114 and/or the second contact 124 can thus be employed to reduce or prevent the occurrence of an arc, or the effects thereof upon adjoining parts, such as the first contact arrangement 110, the second contact arrangement 120 and/or the housing 105. Specifically, they can influence the location at which an arc occurs to the extent that the arc, for example upon the closing of the switch 100, is constituted between the first contact 114 and the second contact 124. The first commutation contact element 112, the second commutation contact element 122, the first contact 114 and/or the second contact 124 can comprise an arc-resistant material.

According to the exemplary embodiments, the first contact 114 can project beyond the first commutation contact element 112 in the direction of the second contact arrangement 120, and the second contact 124 can project beyond the second commutation contact element 122 in the direction of the first contact arrangement 110, when the first contact 114 moves to the closed contact position. In other words, upon the closing of the switch 100, a distance between the first contact 114 and the second contact 124 is smaller in relation to a distance between the first commutation contact element 112 and the second commutation contact element 122, in the direction of the axis (A). Thus, upon the movement of the first contact 114 to the closed contact position, a distance between the first contact 114 and the second contact 124 can be smaller than a distance between the first commutation contact element 112 and the second commutation contact element 122. As a result, an arc is preferentially constituted between the first contact 114 and the second contact 124, rather than between the first commutation contact element 112 and the second commutation contact element 122.

According to the exemplary embodiments, the first limit stop 118, in combination with the first commutation contact element 112, can be moved against and/or in the direction of the force of the elastic element 116. Specifically, upon the movement of the first commutation contact element 112 from the closed commutation contact element position, provided that the snap-action connection is constituted, the first limit stop 118, in combination with the first commutation contact element 112, can be moved against the direction of the force of the elastic element 116. The elastic element 116 can be tensioned accordingly. After the release of the snap-action connection, the elastic element 116 can be detensioned, and the first limit stop 118, in combination with the first commutation contact element 112, can be moved in the direction of the force of the elastic element 116.

Upon the opening of the switch 100, two movement sequences can thus be executed in a superimposed manner. The first movement sequence corresponds to the movement of the first contact 114 from the closed contact position to the open contact position. This movement is essentially executed uniformly along a contact path, corresponding to a path traversed by the second contact 114 from the closed contact position to the open contact position, specifically to an end point of the contact position. The movement of the first contact 114 along the contact path can be executed as first speed v1. The first speed v1 can essentially be constant over the entire contact path. The contact path can also be traversed by the second limit stop 119 at the first speed v1.

The second movement sequence corresponds to the movement of the first commutation contact element 112 from the closed commutation contact element position to the open commutation contact element position. During a first part of the contact path, the snap-action connection remains in the closed state, and the first commutation contact element 112 does not move away from the second commutation contact element 122. Over the first part of the contact path, there is thus a relative movement between the first commutation contact element 112 and the second contact 114.

Over the first part of the contact path, there is thus also are relative movement between the first limit stop 118, which is configured to move in combination with the first commutation contact element 112, and the second limit stop 119, which is configured to move in combination with the first contact 114. The first limit stop 118 and the second limit stop 119 thus move towards one another. As the elastic element 116 is fitted between the first limit stop 118 and the second limit stop 119, the elastic element 116 is tensioned by the movement of the first limit stop 118 and the second limit stop 119 towards one another.

Once a given path has been traversed, which corresponds to a distance between the first limit stop 118 and the second limit stop 119 in the open commutation contact element position, a defined limit stop position is achieved, in which the first limit stop 118 and the second limit stop 119 engage with one another, and the second limit stop 119 entrains the first limit stop 118 in the direction of the open contact position, in a form-fitted arrangement. In turn, this has the consequence that the first commutation contact element 112 is also moved, at the first speed v1, to the open commutation contact element position. The snap-action connection is released as a result. By the release of the snap-action connection, however, no further counterforce is applied to the elastic element 116 which would tension the elastic element 116. Upon the overrun of the first part of the contact path, or the release of the snap-action connection, the elastic element 116 is thus detensioned, and entrains the first commutation contact element 112 at a drawing speed Vz in the direction of the open commutation contact element position. The second commutation contact element 112 thus traverses a path which is dictated by the first limit stop 118 and the second limit stop 119, specifically by a distance between the first limit stop 118 and the second limit stop 119.

The drawing speed Vz, at which the elastic element 116 draws the first commutation contact element 112 in the direction of the open commutation contact element position, is added to the first speed v1 at which the first commutation contact element 112 is moved by means of the form-fitted connection between the first limit stop 118 and the second limit stop 119. The first commutation contact element 112 is thus separated from the second commutation contact element 122 at a second speed v2 which is greater than the first speed v1. The drawing speed Vz is preferably greater than the first speed. The second speed v2 thus corresponds to the sum of the first speed v1 and the drawing speed Vz, i.e. $v2=v1+Vz$. Accordingly, the speed at which the first commutation contact element 112 moves away from the second commutation contact element 122 can be increased. The occurrence of arcing, and the damage associated therewith, can also be reduced accordingly. Specifically, the first commutation contact element 112 can be moved further away from the second contact arrangement 120 than the first contact 114.

For the movement of the first contact 114, a drive mechanism (not represented) can be provided. The drive mechanism can drive the first contact 114, in order to move the first contact 114, specifically along the axis A, from the first contact position to the second contact position, and from the second contact position to the first contact position. For example, the drive mechanism can be connected via a gear train, specifically a linear gear train, to the first contact in a form-fitted manner, in order to move the first contact along the axis A. Specifically, the drive mechanism can dictate the first speed v1.

Figure 2:
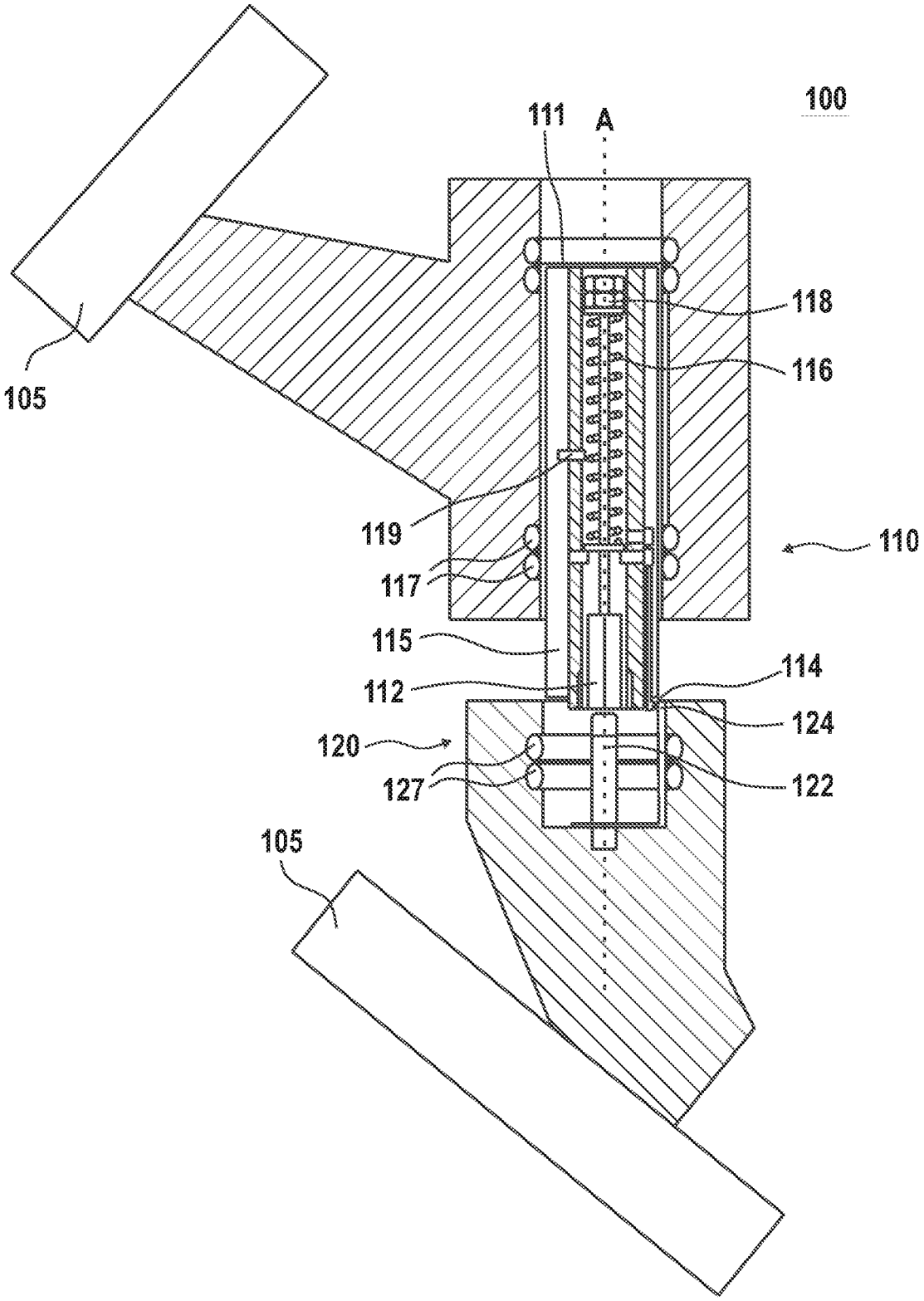
FIG. 2 shows a schematic partial view of a switch shortly before the closing of the snap-action connection, according to exemplary embodiments of the invention.

FIG. 2 shows a schematic partial view of the switch 100 in motion from the open commutation contact element position to the closed commutation contact element position, specifically shortly before the first commutation contact element 112 engages with the second commutation contact element 122. As can been seen from FIG. 2, the first contact 114 engages with the second contact 124 before the first commutation contact element 112 engages with the second commutation contact element 122. As a result, an arc can deliberately be constituted between the first contact 114 and the second contact 124 whereby, specifically, damage to the first commutation contact element 112 and the second commutation contact element 122 can be prevented.

Upon the movement from the open commutation contact element position to the closed commutation contact element position, the first commutation contact element 112, the first contact 114, the first limit stop 118 and the second limit stop 119, in combination, can be moved in the direction of the second contact arrangement 120. Specifically, by the movement from the open commutation contact element position to the closed commutation contact element position, any tensioning of the elastic element 116 can be relieved.

If the movement in the direction of the closed commutation contact element position is further executed beyond the state represented in FIG. 2, the closed contact position is firstly achieved, in which the first contact 114 engages with the second contact 124, before the closed commutation contact element position is achieved, in which the first commutation contact element 112 engages with the second commutation contact element 122. If one of the commutation contact elements 112, 122 is configured as a contact tulip, and the other commutation contact element 112, 122 is configured as a contact pin, the tulip contact can fit over the contact pin, and a commutation contact is constituted between the first commutation contact element 112 and the second commutation contact element 122.

Moreover, in the closed commutation contact element position, the snap-action described herein between the first commutation contact element 112 and the second commutation contact element 122 is constituted. The snap-action connection not only provides a mechanically stable connection between the first commutation contact element 112 and the second commutation contact element 122 but, in combination with the bearing arrangement of the first commutation contact element 112 in the first contact arrangement 110 via the elastic element 116, an advantage is provided in that the speed of separation of the first contact arrangement 112 from the second contact arrangement 122 can be increased.

Figure 3:
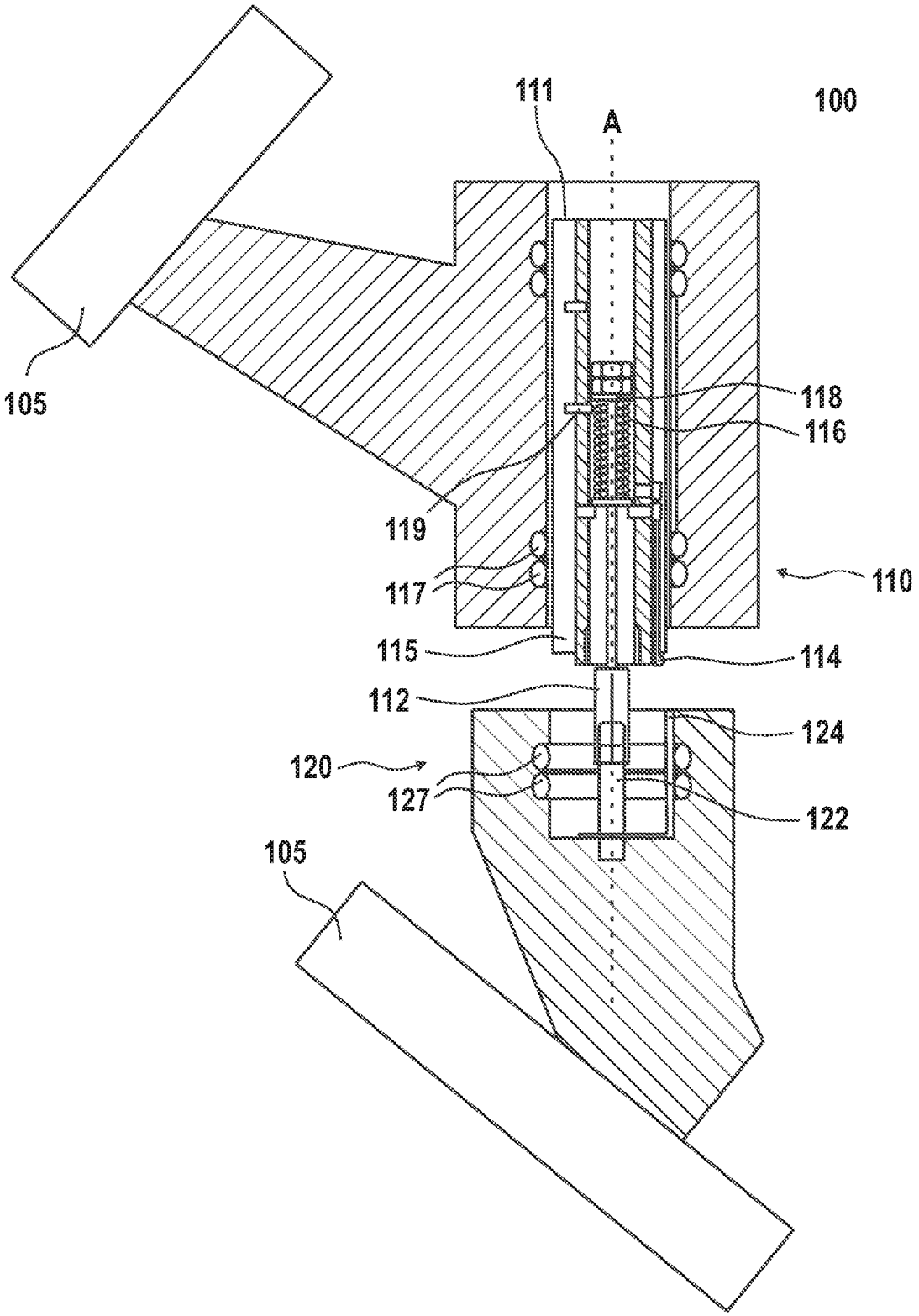
FIG. 3 shows a schematic partial view of a switch in a state shortly before the disconnection of the snap-action connection, according to exemplary embodiments of the invention.

FIG. 3 shows a schematic partial view of the switch 100 in motion from the closed commutation contact element position to the open commutation contact element position, specifically in a state shortly before the release of the snap-action connection. In this state, the first commutation contact element 112 and the second commutation contact element 122 are still in the closed commutation contact element position, and the first commutation contact element 112 is thus yet to be separated from the second commutation contact element 122. In FIG. 3, the first commutation contact element 112 and the second commutation contact element 122 are shown in a quasi-transparent representation, as a result of which both outlines are visible in the contact region. Conversely, the first contact 114 can already be separated from the second contact 124. Moreover, the contact part 115 can also already be in the open contact part position, i.e. can already be separated from the second discharge contact 127.

As shown in FIG. 3, the first commutation contact element 112, in this state, can project beyond the first contact 114 in the direction of the second contact arrangement 120. The first contact 114 can thus already have traversed part of the path in the direction of the open contact position. In the state represented in FIG. 3, the limit stop position has yet to be achieved, in which the snap-action connection is released. Consequently, the first limit stop 118 is still spaced from the second limit stop 119, and the form-fitted connection of the first limit stop 118 to the second limit stop 119 has yet to be established. The state represented in FIG. 3 thus constitutes a state in which the first movement sequence, as described herein, is complete, and the second movement sequence is at a state in which the first part of the contact path has yet to be overrun, such that the first contact 114 and the second limit stop are moved in relation to the first commutation contact element 112 and the first limit stop 118. The elastic element 116 is thus not tensioned (as yet).

If the movement in the direction of the open commutation contact element position is pursued beyond the state represented in FIG. 3, a form-fitted connection is achieved between the first limit stop 118 and the second limit stop 119, as a result of which the snap-action connection is released. The first commutation contact element 112 is then moved indirectly via the first contact 114. Thereafter, the elastic element 116 is detensioned, and draws the first commutation contact element 112 away from the second commutation contact element 122 at the drawing speed Vz. This movement is superimposed upon the movement of the first contact arrangement 110, at the first speed v1, away from the second contact arrangement 120, such that the first commutation contact element 112 moves away from the second contact arrangement 120 at the second speed v2=v1+Vz.

Exemplary embodiments also include gas-insulated switchgear, which comprises one or more switches according to the exemplary embodiments described. For exemplary purposes, the invention has been described with reference to a switch, specifically with reference to an inert-gas switch. However, the invention is also suitable for other switches in high- and medium-voltage applications, specifically in substations, e.g. in vacuum isolating switches, self-blast power circuit-breakers, etc. The invention is also suitable for alternative gas switches, i.e. switches which are specifically filled with an alternative gas to $SF_6$, as described herein. The invention is also suitable for switches which are filled with oil, air, or another insulating medium.

The present invention thus provides a method for disconnecting a switch 100. The switch 100 comprises a housing 105, a first contact arrangement 110, having a first commutation contact element 112 and a first contact 114, and a second contact arrangement 120, having a second commutation contact element 122 and a second contact 124, wherein the first contact 114 projects beyond the first commutation contact element 112 in the direction of the second contact arrangement 120, and the second contact 124 projects beyond the second commutation contact element 122 in the direction of the first contact arrangement 110. Disconnection of the switch 100 proceeds from a closed commutation contact element position, in which the first commutation contact element 112 engages with the second commutation contact element 122, to an open commutation contact element position, in which the first commutation contact element 112 is separated from the second commutation contact element 122. The method comprises a movement, at a first speed v1, of the first contact 114, in the presence of a snap-action connection between the first commutation contact element 112 and the second commutation contact element 122, along an axis A from a closed contact position, in which the first contact 114 engages with the second contact 124, to an open contact position, in which the first contact 114 is separated from the second contact 124. If the first contact 114, with the snap-action connection in place, is moved from the closed contact position in the direction of the open contact position, the elastic element 116 tensions the first commutation contact element 112 in the direction of the open commutation contact element position. If the first contact 114, during the movement in the direction of the open contact position, overshoots a defined limit stop position, the snap-action connection is released, and the first commutation contact element 112 moves in the direction of the open commutation contact element position at a second speed v2, wherein the second speed v2 is greater than the first speed v1.

One cycle for the completion of a closing movement and an opening movement can specifically comprise three contacting stages. Upon the closing of the switch 100, the first contact 114 can firstly engage with the second contact 124, as a result of which a commutation current can flow between the first contact 114 and the second contact 124. Thereafter, the contact part 115 can engage with the second discharge contact 127, as a result of which the switch 100 can be closed. By means of the contact part 115, upon contact with the second discharge contact 127, the nominal current can flow. Upon the opening of the switch, the contact part 115 can firstly be separated from the discharge contact 127. The first contact 114 can then be separated from the second contact 124. Thereafter, the first contact element 112 can be separated from the second contact element 122 via the snap-action connection, as a result of which a commutation current can flow between the first contact element 112 and the second contact element 122. Thus, upon opening and closing, the occurrence of arcing can be reduced, and any damage to the switch can be restricted accordingly.

The invention claimed is:

1. A switch, comprising:

a housing;

a nominal contact arrangement;

a first contact arrangement, having a first commutation contact element and a first contact; and a second contact arrangement, having a second commutation contact element and a second contact, wherein the first contact is moveable along an axis between a closed contact position, in which the first contact engages with the second contact, and an open contact position, in which the first contact is separated from the second contact, and wherein the first commutation contact element is moveable along the axis between a closed commutation contact position, in which the first commutation contact element engages with the second commutation contact element, and an open commutation contact position, in which the first commutation contact element is separated from the second commutation contact element, wherein the first commutation contact element and the second commutation contact element are designed, in the closed commutation contact element position, to mutually constitute a snap-action connection, and wherein, when the switch is closed, a distance between the first contact and the second contact, in relation to a distance between the first commutation contact element and the second commutation contact element in a direction of the axis, is smaller, and wherein the first commutation contact element is coupled to the first contact via a first limit stop, a second limit stop and an elastic element such that a) when the first contact is moved to the closed contact position, the first limit stop entrains the first commutation contact element to the closed commutation contact element position, b) when the first contact, with the snap-action connection in place, is moved from the closed contact position in a direction of the open contact position, the elastic element applies tension to the first commutation contact element in a direction of the open commutation contact element position, c) when the first contact, during a movement thereof in the direction of the open contact position, overshoots a defined limit stop position, the second limit stop entrains the first commutation contact element in the direction of the open commutation contact element position, in order to release the snap-action connection.

2. The switch as claimed in claim 1, wherein the elastic element is a compression spring.

3. The switch as claimed in claim 2, wherein the first contact projects beyond the first commutation contact element in a direction of the second contact arrangement, and the second contact projects beyond the second commutation contact element in a direction of the first contact arrangement, when the first contact moves to the closed contact position.

4. The switch as claimed in claim 2, wherein the first limit stop, in combination with the first commutation contact element, can move against and/or in a direction of a force of the elastic element.

5. The switch as claimed in claim 2, wherein the first contact is moveable in combination with a contact part of the nominal contact arrangement.

6. The switch as claimed in claim 2, further comprising a drive mechanism for driving the first contact.

7. The switch as claimed in claim 1, wherein the first contact is moveable in combination with a contact part of the nominal contact arrangement.

8. The switch as claimed in claim 1, wherein the first contact projects beyond the first commutation contact element in a direction of the second contact arrangement, and the second contact projects beyond the second commutation contact element in a direction of the first contact arrangement, when the first contact moves to the closed contact position.

9. The switch as claimed in claim 1, wherein the first limit stop, in combination with the first commutation contact element, can move against and/or in a direction of a force of the elastic element.

10. The switch as claimed in claim 1, wherein the second limit stop can be moved in relation to the first commutation contact element and, in combination with the first limit stop, dictates a path along which the first commutation contact element can be moved.

11. The switch as claimed in claim 1, wherein the first commutation contact element is configured as a tulip contact and the second commutation contact element is configured as a contact pin, such that the first commutation contact element partially encloses the second commutation contact element in the closed switch state.

12. The switch as claimed in claim 1, wherein the second commutation contact element incorporates a taper in which, in the closed switch state, a widened section of the first commutation contact element engages, in order to constitute the snap-action connection.

13. The switch as claimed in claim 1, further comprising a drive mechanism for driving the first contact.

14. The switch as claimed in claim 1, wherein the switch is an isolating switch, a combined isolating and grounding switch, a power switch or a grounding switch.

15. The switch as claimed in claim 1, wherein the snap-action connection between the first commutation contact element and the second commutation contact element is constituted by a form-fitted connection between the first commutation contact element and the second commutation contact element.

16. The switch as claimed in claim 1, wherein the first contact and/or the second contact are configured in a circumferential direction about the axis.

17. The switch as claimed in claim 1, wherein the switch is designed for a nominal voltage equal to or greater than 53 kV.

18. The switch as claimed in claim 1, wherein the switch is designed for a nominal voltage equal to or greater than 100 kV.

19. A method for disconnecting a switch, comprising a housing, a nominal contact arrangement, a first contact arrangement, having a first commutation contact element and a first contact, and a second contact arrangement, having a second commutation contact element and a second contact wherein, upon a closing of the switch, a distance between the first contact and the second contact, in relation to a distance between the first commutation contact element and the second commutation contact element, in a direction of an axis, is smaller, wherein the first commutation contact element is moveable from a closed commutation contact element position, in which the first commutation contact element engages with the second commutation contact element, to an open commutation contact element position, in which the first commutation contact element is separated from the second commutation contact element, wherein the method comprises:

a movement, at a first speed, of the first contact, in a presence of a snap-action connection between the first commutation contact element and the second commutation contact element, along the axis from a closed contact position, in which the first contact engages with the second contact, to an open contact position, in which the first contact is separated from the second contact, wherein, if the first contact, with the snap-action connection in place, is moved from the closed contact position in a direction of the open contact position, an elastic element tensions the first commutation contact element in a direction of the open commutation contact element position, and wherein if the first contact, during a movement in the direction of the open contact position, overshoots a defined limit stop position, the snap-action connection is released, and the first commutation contact element moves in the direction of the open commutation contact element position at a second speed, wherein the second speed is greater than the first speed.

20. The method as claimed in claim 19 wherein, upon the closing of the switch, the first contact and the second contact engage temporally in advance of the first commutation contact element and the second commutation contact element, such that an arc is constituted between the first contact and the second contact, as a result of which the first commutation contact element and the second commutation contact element, during an operation of the switch are protected against damage; and wherein upon an opening of the switch, an electrical connection between the first contact and the second contact is interrupted temporally in advance of the electrical connection between the first commutation contact element and the second commutation contact element, such that an arc is constituted between the first commutation contact element and the second commutation contact element, as a result of which the first contact and the second contact, during the operation of the switch, are protected against damage.

* * * * *